US011852109B1

(12) United States Patent
Rundell et al.

(10) Patent No.: US 11,852,109 B1
(45) Date of Patent: Dec. 26, 2023

(54) VEHICLE GAS DISTRIBUTION TO INTAKE MANIFOLD RUNNERS

(71) Applicant: GM GLOBAL TECHNOLOGY OPERATIONS LLC, Detroit, MI (US)

(72) Inventors: Drake Rundell, Auburn Hills, MI (US); Christopher K. Clarke, Commerce, MI (US); Matthew Neil Gould, Swartz Creek, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/895,157

(22) Filed: Aug. 25, 2022

(51) Int. Cl.
*F02M 35/10* (2006.01)
*F02M 35/104* (2006.01)

(52) U.S. Cl.
CPC .. *F02M 35/10052* (2013.01); *F02M 35/1036* (2013.01); *F02M 35/10045* (2013.01); *F02M 35/1045* (2013.01); *F02M 35/10072* (2013.01); *F02M 35/10222* (2013.01); *F02M 35/10321* (2013.01)

(58) Field of Classification Search
CPC ..... F02M 35/10045; F02M 35/10052; F02M 35/10072; F02M 35/10222; F02M 35/10321; F02M 35/1036; F02M 35/1045; F02M 35/104–1165; F02M 35/10026–10065
See application file for complete search history.

(56) References Cited

U.S. PATENT DOCUMENTS

| | | | | |
|---|---|---|---|---|
| 7,328,692 | B2 * | 2/2008 | Nakamura | F02M 35/161 123/184.21 |
| 8,051,841 | B2 * | 11/2011 | Pantow | F02M 26/05 123/568.12 |
| 10,352,277 | B2 * | 7/2019 | Ito | F02M 26/20 |
| 10,359,007 | B2 * | 7/2019 | Ito | F02M 35/104 |
| 10,954,902 | B2 * | 3/2021 | Mizuta | F02M 35/104 |

FOREIGN PATENT DOCUMENTS

| | | | | |
|---|---|---|---|---|
| DE | 102004032144 | B4 * | 10/2019 | F01M 13/022 |
| JP | 2017014970 | A * | 1/2017 | |
| JP | 2019148205 | A * | 9/2019 | |
| WO | WO-2021063513 | A1 * | 4/2021 | |

* cited by examiner

*Primary Examiner* — Hung Q Nguyen
*Assistant Examiner* — Mark L. Greene

(57) ABSTRACT

An intake system of an internal combustion engine of a vehicle includes: an intake manifold configured to be fluidly coupled to a throttle valve and including intake runners for cylinders, respectively, of the internal combustion engine; and a plenum that includes a flange configured to receive gas from a valve of the vehicle, that is fixed to the intake manifold, and that includes apertures configured to flow gas from the plenum into the intake manifold one of: between ones of the intake runners; and directly into the intake runners.

14 Claims, 12 Drawing Sheets

VEHICLE GAS DISTRIBUTION TO INTAKE MANIFOLD RUNNERS

INTRODUCTION

The information provided in this section is for the purpose of generally presenting the context of the disclosure. Work of the presently named inventors, to the extent it is described in this section, as well as aspects of the description that may not otherwise qualify as prior art at the time of filing, are neither expressly nor impliedly admitted as prior art against the present disclosure.

The present disclosure relates to internal combustion engines of vehicles and more particularly to gas manifolds and plenums of internal combustion engines.

Some types of vehicles include only an internal combustion engine that generates propulsion torque. Hybrid vehicles include both an internal combustion engine and one or more electric motors. Some types of hybrid vehicles utilize the electric motor and the internal combustion engine in an effort to achieve greater fuel efficiency than if only the internal combustion engine was used. Some types of hybrid vehicles utilize the electric motor and the internal combustion engine to achieve greater torque output than the internal combustion could achieve by itself.

Some example types of hybrid vehicles include parallel hybrid vehicles, series hybrid vehicles, and other types of hybrid vehicles. In a parallel hybrid vehicle, the electric motor works in parallel with the engine to combine power and range advantages of the engine with efficiency and regenerative braking advantages of electric motors. In a series hybrid vehicle, the engine drives a generator to produce electricity for the electric motor, and the electric motor drives a transmission. This allows the electric motor to assume some of the power responsibilities of the engine, which may permit the use of a smaller and possibly more efficient engine. The present application is applicable to electric vehicles, hybrid vehicles, and other types of vehicles.

SUMMARY

In a feature, an intake system of an internal combustion engine of a vehicle includes: an intake manifold configured to be fluidly coupled to a throttle valve and including intake runners for cylinders, respectively, of the internal combustion engine; and a plenum that includes a flange configured to receive gas from a valve of the vehicle, that is fixed to the intake manifold, and that includes apertures configured to flow gas from the plenum into the intake manifold one of: between ones of the intake runners; and directly into the intake runners.

In further features, the plenum includes the apertures configured to flow gas from the plenum into the intake manifold between ones of the intake runners.

In further features, the plenum includes the apertures configured to flow gas from the plenum into the intake manifold directly into the intake runners.

In further features, the plenum is vibration welded to the intake manifold.

In further features, the intake manifold includes: a lower portion configured to be fixed to the internal combustion engine; a middle portion that is fixed to the lower portion; and an upper portion that is fixed to the middle portion.

In further features, the lower portion is vibration welded to the middle portion, and the upper portion is vibration welded to the middle portion.

In further features, the middle portion includes a second flange configured to be fluidly coupled to the throttle valve.

In further features, the valve is an exhaust gas recirculation (EGR) valve.

In further features, the valve is a positive crankcase ventilation (PCV) valve.

In further features, the valve is a fuel vapor purge valve.

In further features, the flange is located at a midpoint of the plenum.

In further features, the flange is located closer to a front portion of the plenum than a rear portion of the plenum.

In further features, the flange is located closer to a rear portion of the plenum than a front portion of the plenum.

In further features, all of the apertures are the same size and shape.

In further features, a first size of a first one of the apertures is different than a second size of a second one of the apertures.

In further features, a first shape of a first one of the apertures is different than a second shape of a second one of the apertures.

In further features, the intake manifold and the plenum are made of at least one of a plastic and a metal.

In further features, the intake manifold and the plenum are made of one of Polyamide 6, Polyamide 66, glass fiber, and acrylonitrile butadiene styrene (ABS) plastic.

In a feature, an intake system of an internal combustion engine of a vehicle includes: an intake manifold configured to be fluidly coupled to a throttle valve and including intake runners for cylinders, respectively, of the internal combustion engine; and a plenum that includes a flange configured to receive exhaust from an exhaust gas recirculation (EGR) valve of the vehicle, that is fixed to the intake manifold, and that includes apertures configured to flow exhaust from the plenum into the intake manifold between ones of the intake runners.

In a feature, an intake system of an internal combustion engine of a vehicle includes: an intake manifold configured to be fluidly coupled to a throttle valve and including intake runners for cylinders, respectively, of the internal combustion engine; and a plenum that includes a flange configured to receive exhaust from an exhaust gas recirculation (EGR) valve of the vehicle, that is fixed to the intake manifold, and that includes apertures configured to flow exhaust from the plenum into the intake manifold directly into the intake runners, respectively.

Further areas of applicability of the present disclosure will become apparent from the detailed description, the claims and the drawings. The detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

In the drawings, reference numbers may be reused to identify similar and/or identical elements.

DETAILED DESCRIPTION

Figure 1:
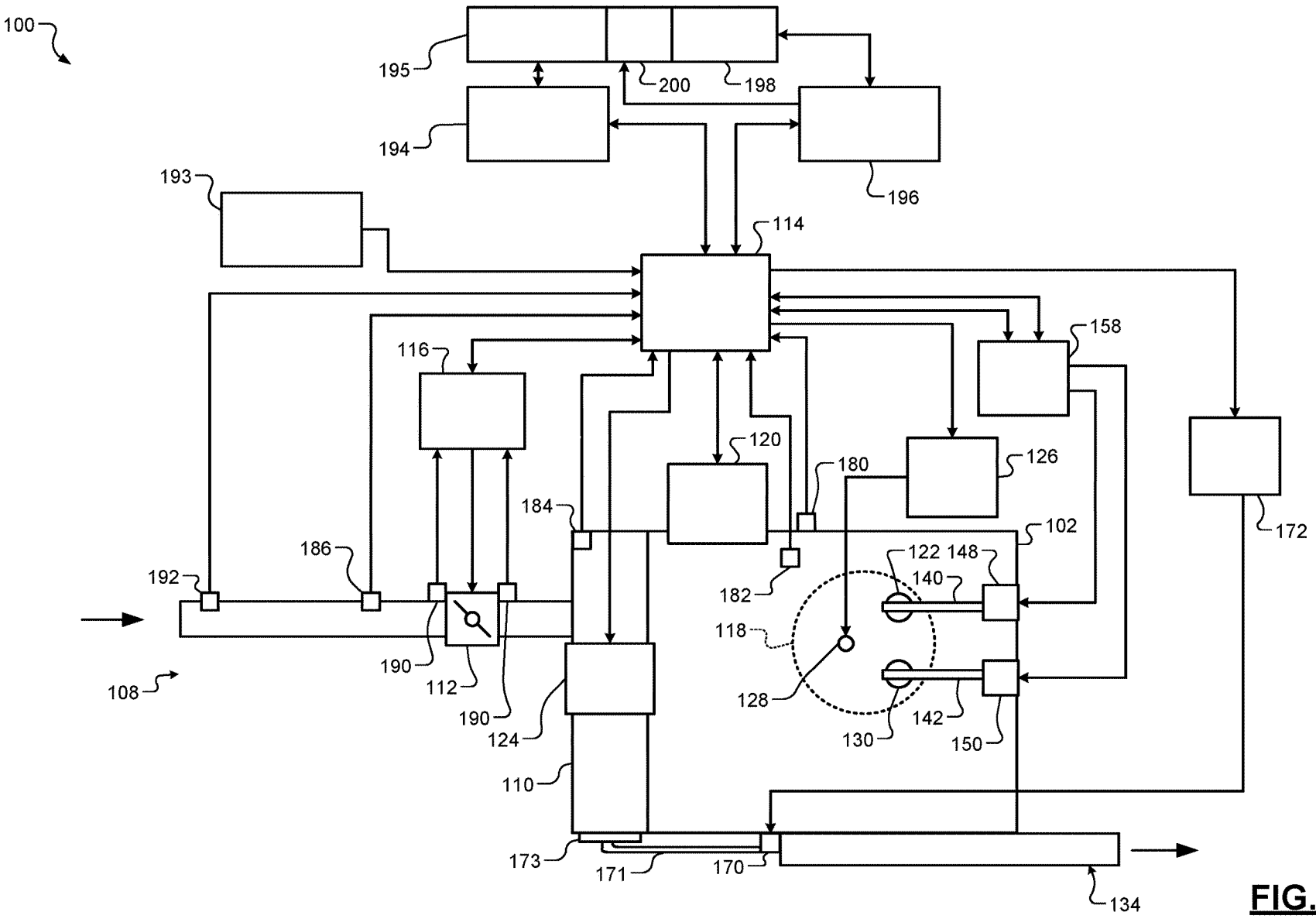
FIG. 1 is a functional block diagram of an example engine control system.

Referring now to FIG. 1, a functional block diagram of an example powertrain system 100 is presented for a hybrid vehicle. While the example of a hybrid vehicle is provided, the present application is applicable to non-vehicle applications and other types of vehicles including an internal combustion engine. The powertrain system 100 of a vehicle includes an engine 102 that combusts an air/fuel mixture to produce torque. The vehicle may be non-autonomous, semi-autonomous, or autonomous.

Air is drawn into the engine 102 through an intake system 108. The intake system 108 may include an intake manifold 110 and a throttle valve 112. For example only, the throttle valve 112 may include a butterfly valve having a rotatable blade. An engine control module (ECM) 114 controls a throttle actuator module 116, and the throttle actuator module 116 regulates opening of the throttle valve 112 to control airflow into the intake manifold 110.

Air from the intake manifold 110 is drawn into cylinders of the engine 102. While the engine 102 includes multiple cylinders, for illustration purposes a single representative cylinder 118 is shown. For example only, the engine 102 may include 2, 3, 4, 5, 6, 8, 10, and/or 12 cylinders. The ECM 114 may instruct a cylinder actuator module 120 to selectively deactivate some of the cylinders under some circumstances, which may improve fuel efficiency.

The engine 102 may operate using a four-stroke cycle or another suitable engine cycle. The four strokes of a four-stroke cycle, described below, will be referred to as the intake stroke, the compression stroke, the combustion stroke, and the exhaust stroke. During each revolution of a crankshaft (not shown), two of the four strokes occur within the cylinder 118. Therefore, two crankshaft revolutions are necessary for the cylinder 118 to experience all four of the strokes. For four-stroke engines, one engine cycle may correspond to two crankshaft revolutions.

When the cylinder 118 is activated, air from the intake manifold 110 is drawn into the cylinder 118 through an intake valve 122 during the intake stroke. The ECM 114 controls a fuel actuator module 124, which regulates fuel injection to achieve a desired air/fuel ratio. Fuel may be injected into the intake manifold 110 at a central location or at multiple locations, such as near the intake valve 122 of each of the cylinders. In various implementations (not shown), fuel may be injected directly into the cylinders or into mixing chambers/ports associated with the cylinders. The fuel actuator module 124 may halt injection of fuel to cylinders that are deactivated.

The injected fuel mixes with air and creates an air/fuel mixture in the cylinder 118. During the compression stroke, a piston (not shown) within the cylinder 118 compresses the air/fuel mixture. The engine 102 may be a compression-ignition engine, in which case compression causes ignition of the air/fuel mixture. Alternatively, the engine 102 may be a spark-ignition engine, in which case a spark actuator module 126 energizes a spark plug 128 in the cylinder 118 based on a signal from the ECM 114, which ignites the air/fuel mixture. Some types of engines, such as homogenous charge compression ignition (HCCI) engines may perform both compression ignition and spark ignition. The timing of the spark may be specified relative to the time when the piston is at its topmost position, which will be referred to as top dead center (TDC).

The spark actuator module 126 may be controlled by a timing signal specifying how far before or after TDC to generate the spark. Because piston position is directly related to crankshaft rotation, operation of the spark actuator module 126 may be synchronized with the position of the crankshaft. The spark actuator module 126 may disable provision of spark to deactivated cylinders or provide spark to deactivated cylinders.

During the combustion stroke, the combustion of the air/fuel mixture drives the piston down, thereby driving the crankshaft. The combustion stroke may be defined as the time between the piston reaching TDC and the time when the piston returns to a bottom most position, which will be referred to as bottom dead center (BDC).

During the exhaust stroke, the piston begins moving up from BDC and expels the byproducts of combustion through an exhaust valve 130. The byproducts of combustion are exhausted from the vehicle via an exhaust system 134.

The intake valve 122 may be controlled by an intake camshaft 140, while the exhaust valve 130 may be controlled by an exhaust camshaft 142. In various implementations, multiple intake camshafts (including the intake camshaft 140) may control multiple intake valves (including the intake valve 122) for the cylinder 118 and/or may control the intake valves (including the intake valve 122) of multiple banks of cylinders (including the cylinder 118). Similarly, multiple exhaust camshafts (including the exhaust camshaft 142) may control multiple exhaust valves for the cylinder 118 and/or may control exhaust valves (including the exhaust valve 130) for multiple banks of cylinders (including the cylinder 118). While camshaft-based valve actuation is shown and has been discussed, camless valve actuators may be implemented. While separate intake and exhaust camshafts are shown, one camshaft having lobes for both the intake and exhaust valves may be used.

The cylinder actuator module 120 may deactivate the cylinder 118 by disabling opening of the intake valve 122 and/or the exhaust valve 130. The time when the intake valve 122 is opened may be varied with respect to piston TDC by an intake cam phaser 148. The time when the exhaust valve 130 is opened may be varied with respect to piston TDC by an exhaust cam phaser 150. A phaser actuator module 158 may control the intake cam phaser 148 and the exhaust cam phaser 150 based on signals from the ECM 114. In various implementations, cam phasing may be omitted. Variable valve lift (not shown) may also be controlled by the phaser actuator module 158. In various other implementations, the intake valve 122 and/or the exhaust valve 130 may be controlled by actuators other than a camshaft, such as electromechanical actuators, electrohydraulic actuators, electromagnetic actuators, etc.

The engine 102 may include an exhaust gas recirculation (EGR) valve 170, which selectively redirects exhaust back from the exhaust system 134 to the engine 102 through an EGR conduit 171. The EGR valve 170 may be controlled by an EGR actuator module 172.

The EGR conduit 171 could recirculate exhaust to a location between the throttle valve 112 and the intake manifold 110. This, however, may increase a packaging space necessary for the engine system. The EGR conduit 171 could be connected to the intake manifold 110. This, however, pose challenges, such as regarding positioning of an EGR diffuser, coking (e.g., on the back side) of the throttle valve 106, and EGR imbalance within the intake manifold 110 and to the cylinders.

As discussed further below, the present application involves an EGR plenum 173 that is fluidly coupled to a vertical top of the intake manifold 110. The EGR conduit 171 is fluidly connected to the EGR plenum 173. Introducing the exhaust into the EGR plenum 173 enables a decreased packaging size and allows recirculated exhaust to be introduced between or into intake runners of the intake manifold 110. This allows for better control of the recirculated exhaust and minimizing EGR imbalance in the intake manifold 110.

Crankshaft position may be measured using a crankshaft position sensor 180. An engine speed may be determined based on the crankshaft position measured using the crankshaft position sensor 180. A temperature of engine coolant may be measured using an engine coolant temperature (ECT) sensor 182. The ECT sensor 182 may be located within the engine 102 or at other locations where the coolant is circulated, such as a radiator (not shown).

A pressure within the intake manifold 110 may be measured using a manifold absolute pressure (MAP) sensor 184. In various implementations, engine vacuum, which is the difference between ambient air pressure and the pressure within the intake manifold 110, may be measured. A mass flow rate of air flowing into the intake manifold 110 may be measured using a mass air flow (MAF) sensor 186. In various implementations, the MAF sensor 186 may be located in a housing that also includes the throttle valve 112.

Position of the throttle valve 112 may be measured using one or more throttle position sensors (TPS) 190. A temperature of air being drawn into the engine 102 may be measured using an intake air temperature (IAT) sensor 192. One or more other sensors 193 may also be implemented. The other sensors 193 include an accelerator pedal position (APP) sensor, a brake pedal position (BPP) sensor, may include a clutch pedal position (CPP) sensor (e.g., in the case of a manual transmission), and may include one or more other types of sensors. An APP sensor measures a position of an accelerator pedal within a passenger cabin of the vehicle. A BPP sensor measures a position of a brake pedal within a passenger cabin of the vehicle. A CPP sensor measures a position of a clutch pedal within the passenger cabin of the vehicle. The other sensors 193 may also include one or more acceleration sensors that measure longitudinal (e.g., fore/aft) acceleration of the vehicle and latitudinal acceleration of the vehicle. An accelerometer is an example type of acceleration sensor, although other types of acceleration sensors may be used. The ECM 114 may use signals from the sensors to make control decisions for the engine 102.

The ECM 114 may communicate with a transmission control module 194, for example, to coordinate engine operation with gear shifts in a transmission 195. The ECM 114 may communicate with a hybrid control module 196, for example, to coordinate operation of the engine 102 and an electric motor 198. While the example of one electric motor is provided, multiple electric motors may be implemented. The electric motor 198 may be a permanent magnet electric motor or another suitable type of electric motor that outputs voltage based on back electromagnetic force (EMF) when free spinning, such as a direct current (DC) electric motor or a synchronous electric motor. In various implementations, various functions of the ECM 114, the transmission control module 194, and the hybrid control module 196 may be integrated into one or more modules.

Each system that varies an engine parameter may be referred to as an engine actuator. Each engine actuator has an associated actuator value. For example, the throttle actuator module 116 may be referred to as an engine actuator, and the throttle opening area may be referred to as the actuator value. In the example of FIG. 1, the throttle actuator module 116 achieves the throttle opening area by adjusting an angle of the blade of the throttle valve 112.

The spark actuator module 126 may also be referred to as an engine actuator, while the corresponding actuator value may be the amount of spark advance relative to cylinder TDC. Other engine actuators may include the cylinder actuator module 120, the fuel actuator module 124, the phaser actuator module 158, and the EGR actuator module 172. For these engine actuators, the actuator values may correspond to a cylinder activation/deactivation sequence, fueling rate, intake and exhaust cam phaser angles, and EGR valve opening, respectively.

The ECM 114 may control the actuator values in order to cause the engine 102 to output torque based on a torque request. The ECM 114 may determine the torque request, for example, based on one or more driver inputs, such as an APP, a BPP, a CPP, and/or one or more other suitable driver inputs. The ECM 114 may determine the torque request, for example, using one or more functions or lookup tables that relate the driver input(s) to torque requests.

Under some circumstances, the hybrid control module 196 controls the electric motor 198 to output torque, for example, to supplement engine torque output. The hybrid control module 196 may also control the electric motor 198 to output torque for vehicle propulsion at times when the engine 102 is shut down.

The hybrid control module 196 applies electrical power from a battery to the electric motor 198 to cause the electric motor 198 to output positive torque. The electric motor 198 may output torque, for example, to an input shaft of the transmission 195, to an output shaft of the transmission 195, or to another component. A clutch 200 may be implemented to couple the electric motor 198 to the transmission 195 and to decouple the electric motor 198 from the transmission 195. One or more gearing devices may be implemented between an output of the electric motor 198 and an input of the transmission 195 to provide one or more predetermined gear ratios between rotation of the electric motor 198 and rotation of the input of the transmission 195. In various implementations, the electric motor 198 may be omitted.

Figure 2:
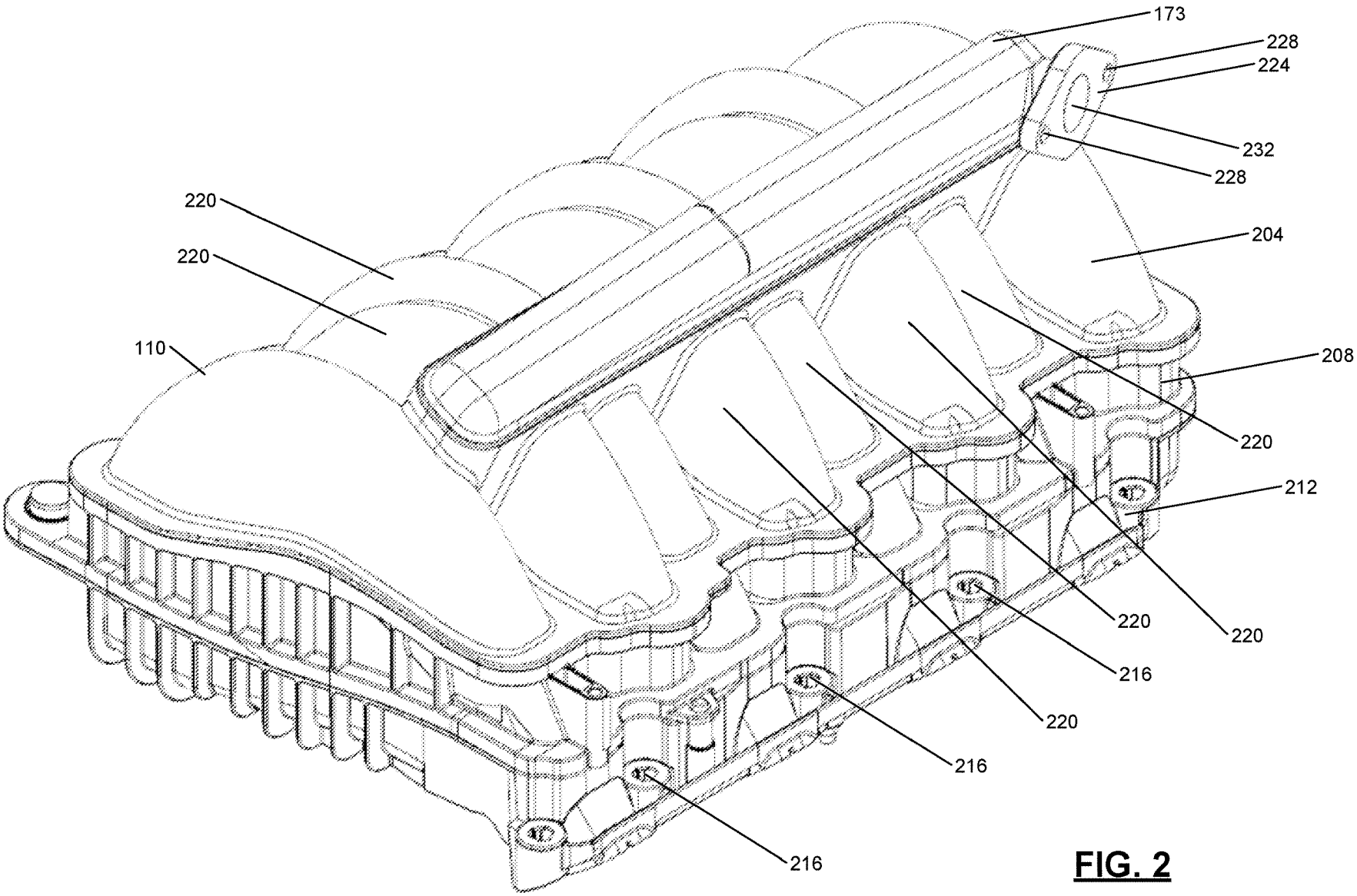
FIGS. 2-6 include an example implementation of the intake manifold and an exhaust gas recirculation (EGR) plenum.
Figure 3:
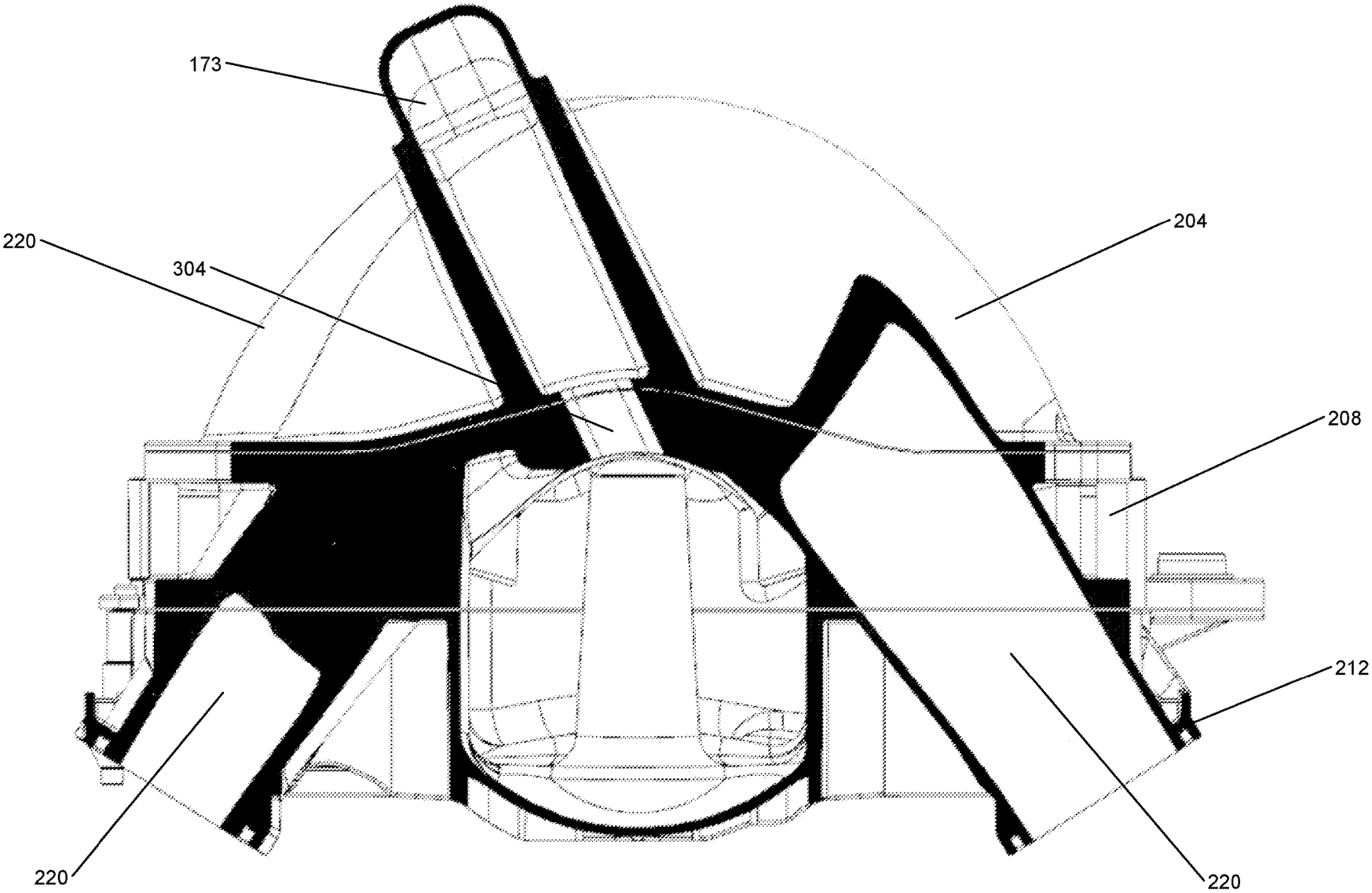
Figure 4:
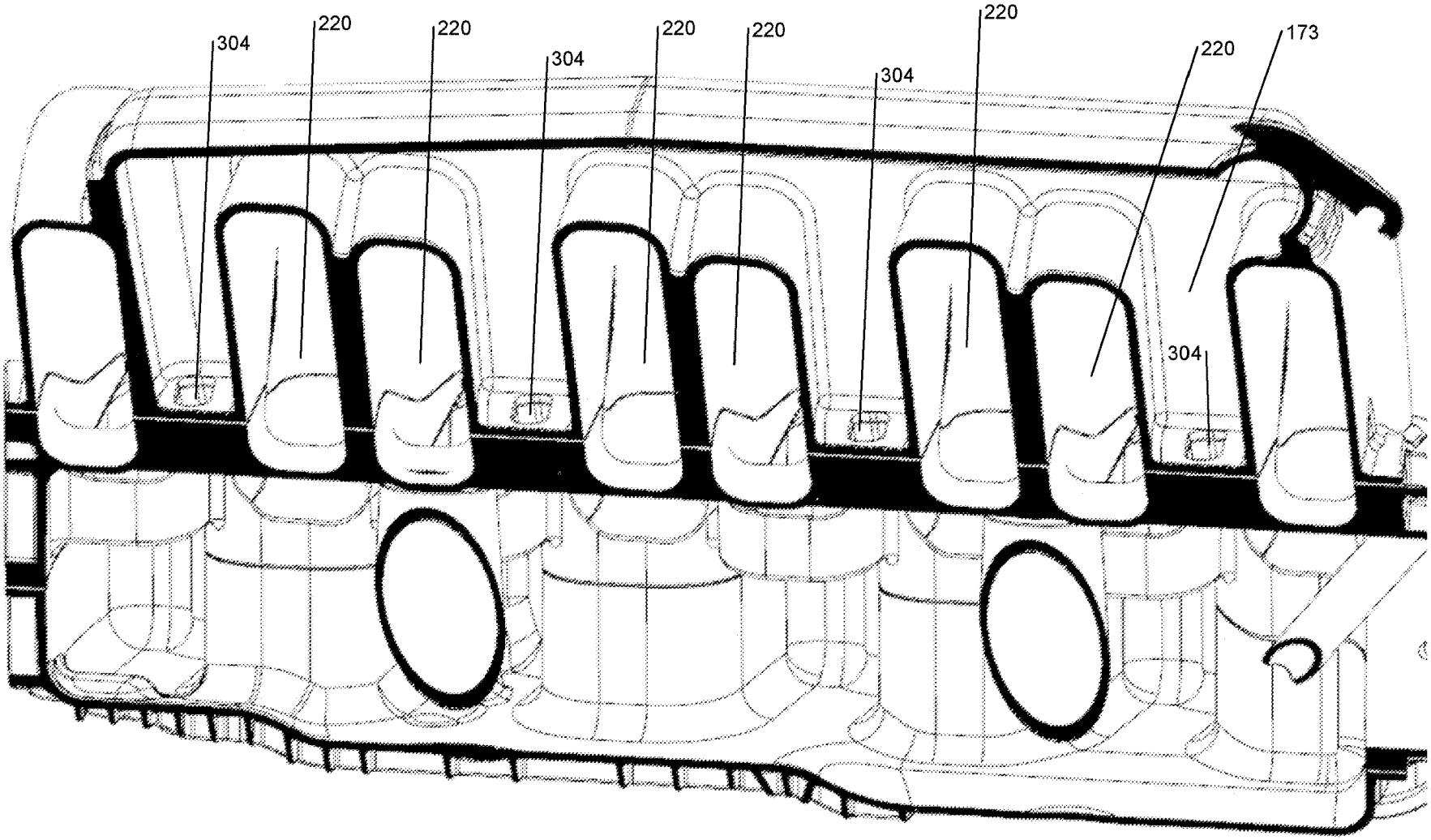
Figure 5:
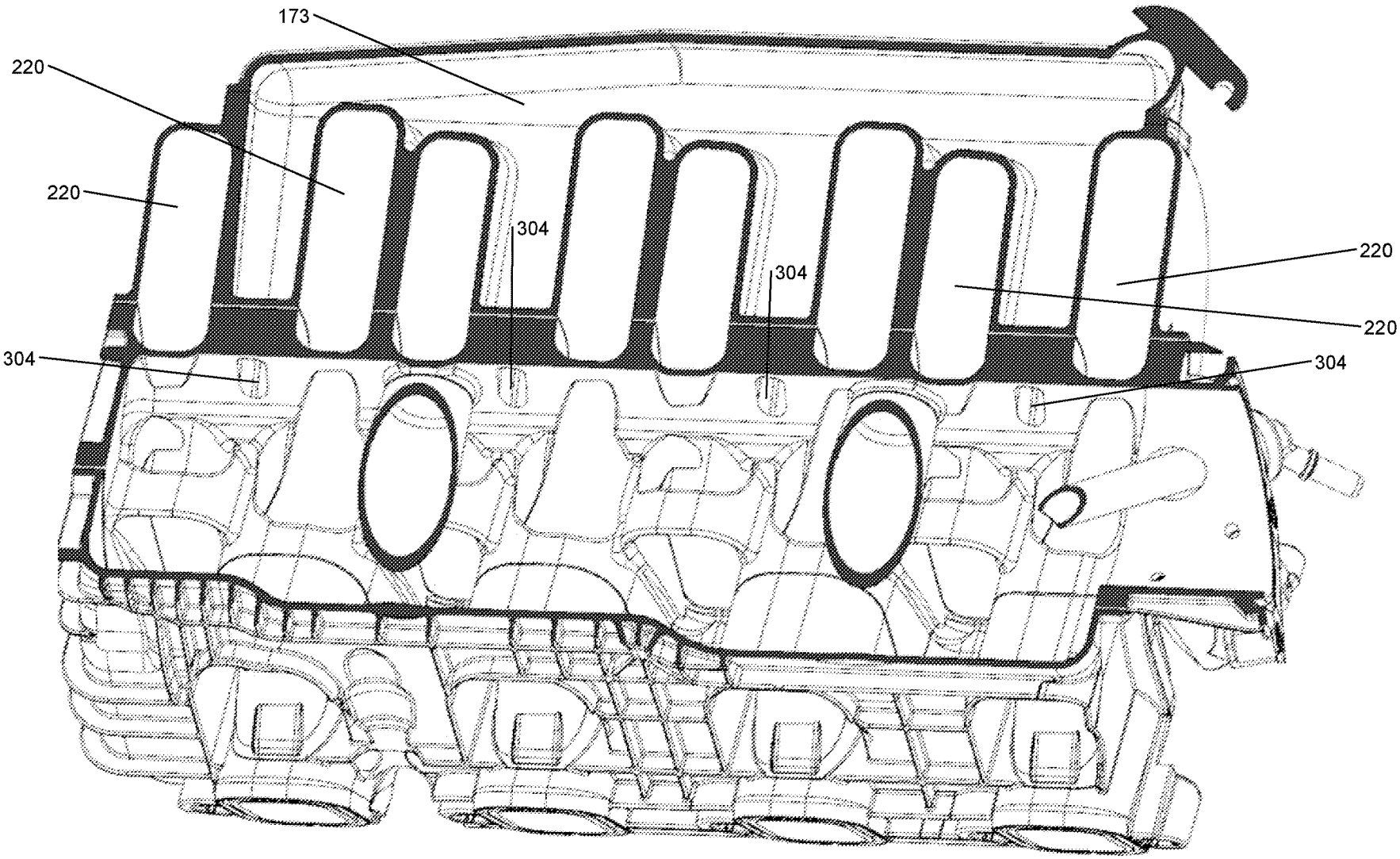
Figure 6:
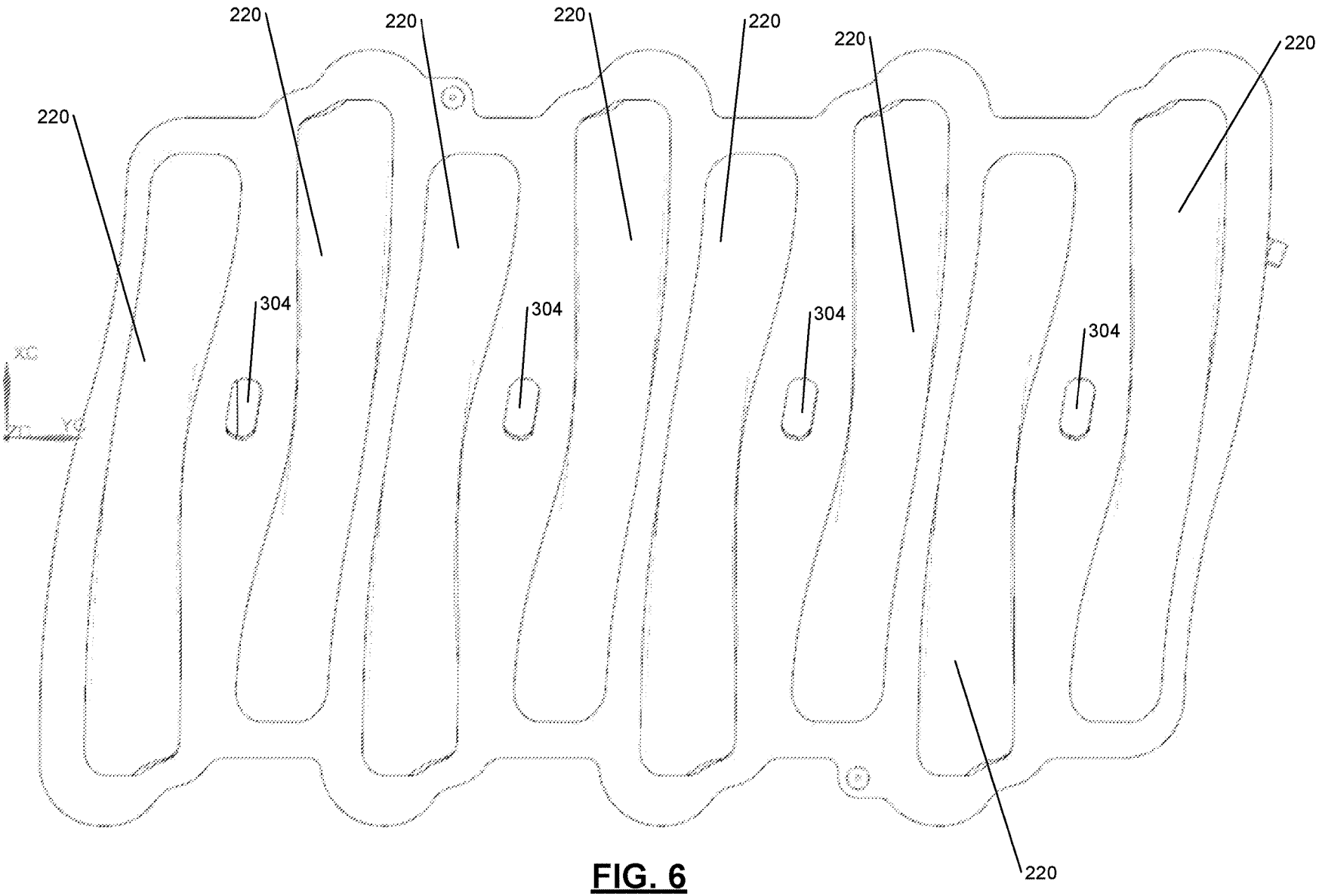
Figure 7:
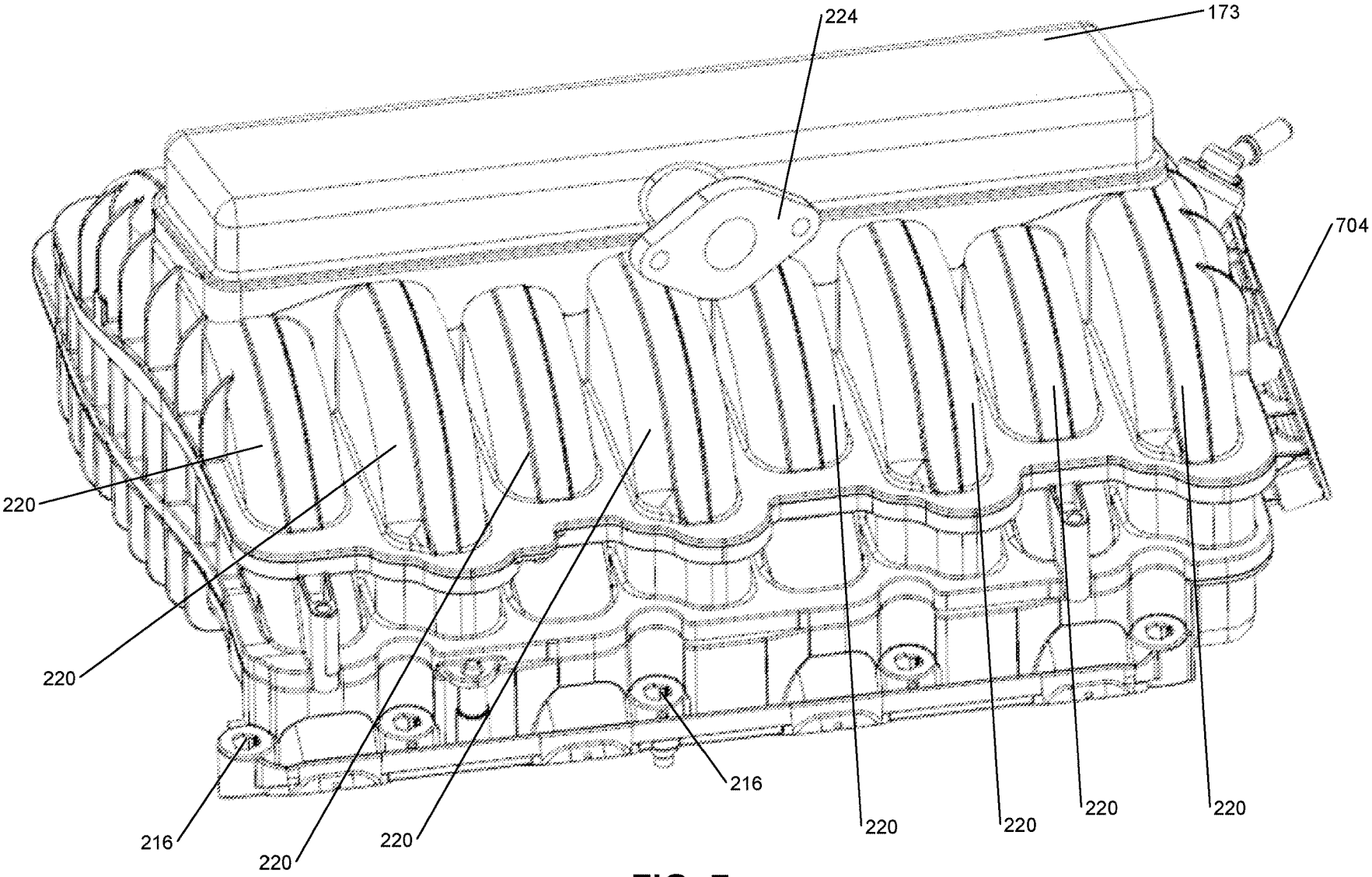
FIGS. 7-10 include an example implementation of the intake manifold and the EGR plenum.

FIGS. 2-6 include an example implementation of the intake manifold 110 and the EGR plenum 173. FIG. 2 includes a perspective view from above and facing a rear of the intake manifold 110 and the EGR plenum 173. The throttle valve 112 may be fixed to a front of the intake manifold 110, such as illustrated in the example of FIG. 7. FIG. 3 includes a cross-sectional view of the intake manifold 110 and the EGR plenum 173 viewed from the front of the intake manifold and the EGR plenum 173. FIG. 4 includes a cross-sectional view vertical down through EGR plenum 173 of the intake manifold 110 from a bottom of the intake manifold 110. FIG. 5 includes a vertical cross-section up through the intake manifold 110 and the EGR plenum 173. FIG. 6 includes a perspective view facing an interior portion showing ports into the intake manifold 110.

As illustrated in FIG. 3, the intake manifold 110 may include three plenums: an upper plenum 204, a middle plenum 208, and a lower plenum 212. The upper plenum 204 is disposed vertically above the middle plenum 208, and the middle plenum 208 is disposed vertically above the lower plenum 212. The middle plenum 208 is sandwiched between the upper and lower plenums 204 and 212. The middle upper, middle, and lower plenums 212 are fixed together, such as by vibration welding, another type of welding, or in another suitable manner. The upper, middle, lower, and EGR plenums 204, 208, 212, and 173 may be made of or include a plastic, such as acrylonitrile butadiene styrene (ABS) plastic, a composite material (e.g., Polyamide 6, Polyamide 66, and glass fiber (e.g., 30%)) one or more metals, or another suitable material. While the example of the intake manifold including three plenums is provided, the EGR plenum 173 can be used with an intake manifold having one or more plenums.

The lower plenum 212 is fixed to the engine 102 (e.g., a cylinder head) via one or more fasteners, such as bolts that extend through apertures 216 through the lower plenum 212. The intake manifold 110 includes intake runners 220 that distribute air flowing into the intake manifold 110 to the cylinders, respectively, of the engine 102. The intake manifold 110 includes one or more intake runners 220 per cylinder. The intake manifold 110 may include one intake runner per intake valve of each cylinder. Some engines may include multiple intake valves per cylinder. Thus, the intake manifold 110 may include multiple intake runners per cylinder.

The EGR plenum 173 is fixed to a vertically upper (e.g., top most) point on the upper plenum 204. The EGR plenum 173 may be fixed to the upper plenum 204, such as by vibration welding, another type of welding, or in another suitable manner. The EGR plenum 173 includes a flange 224 to which the EGR valve 170 can be fastened, such as by one or more bolts through apertures 228. Exhaust gas flows into the EGR plenum 173 through an aperture 232. The aperture 232 and the flange 224 may be formed near the front as illustrated in the example of FIG. 2, near the rear, or between the front and rear most portions. FIG. 7 includes an example illustration with the flange 224 and the aperture 232 being at a midpoint between the front and rear most portions of the EGR plenum 173.

As shown in FIGS. 3-6, exhaust gas flows from the EGR plenum 173 into the intake manifold 110 through apertures 304 that are disposed between ones of the intake runners 220 and not directly into the intake runners 220. In this example, the exhaust mixes with fresh air before the mixture of exhaust and air enters the intake runners 220. The location of the apertures 304 may balance the mixture of exhaust and air flowing through each of the intake runners 220.

The apertures 304 may be circular, oval shaped, rectangular shaped (with or without rounded corners), or another suitable shape. The apertures 304 may each have the same dimensions, or one or more of the apertures 304 may be different, such as to provides the same mixture of exhaust and air to each intake runner. All of the apertures 304 may be disposed along one line, such as illustrated in FIGS. 4-6.

Figure 8:
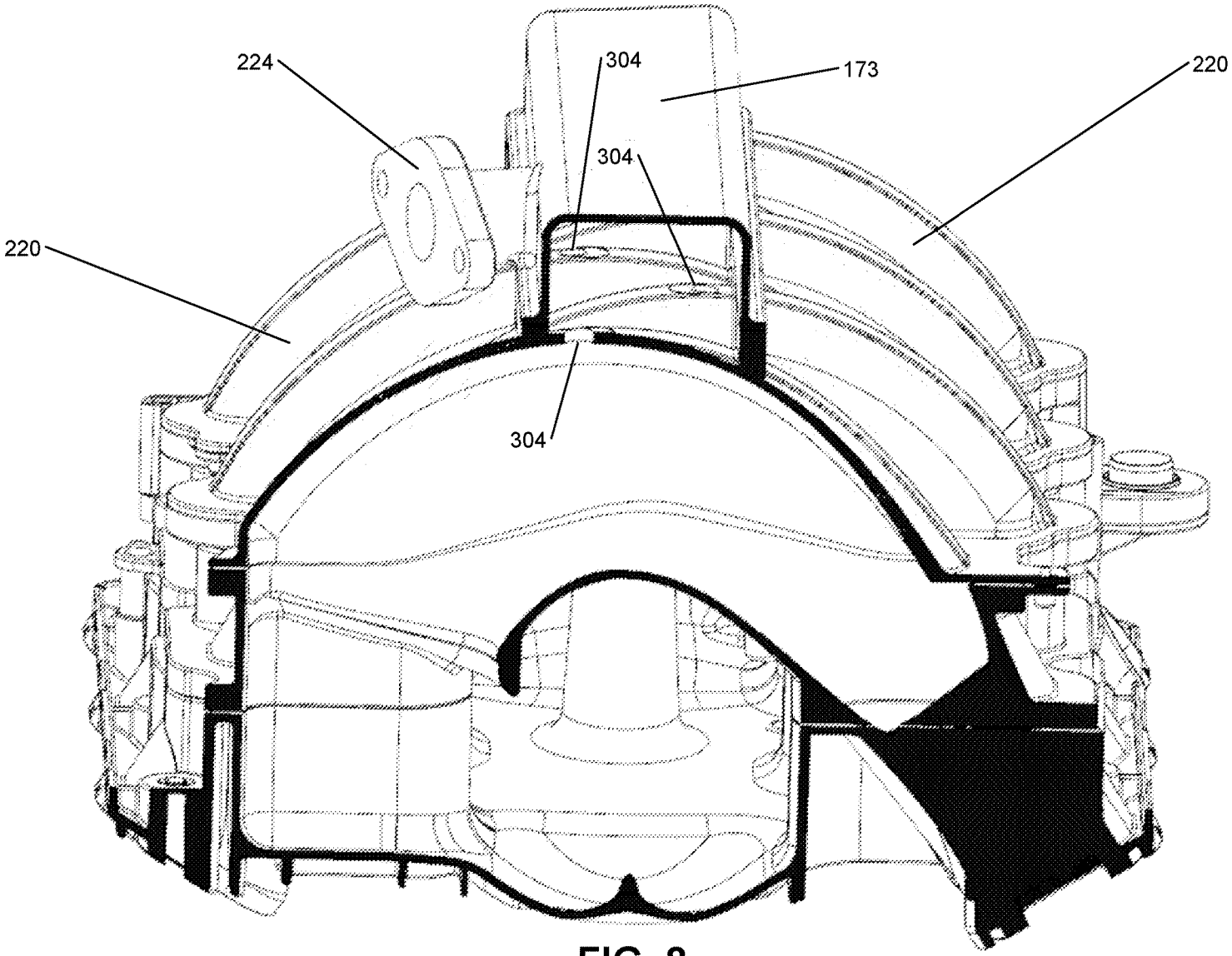
Figure 9:
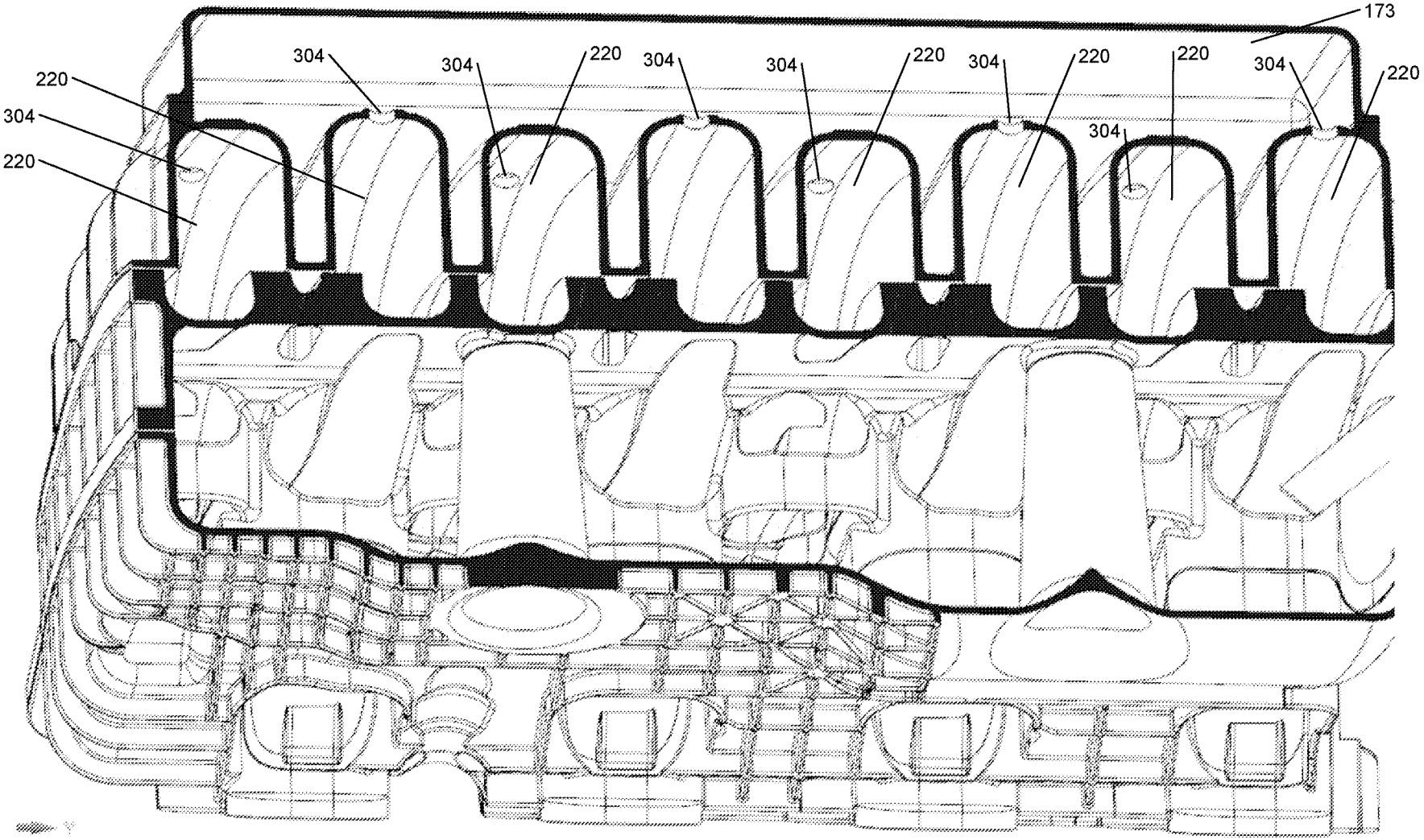
Figure 10:
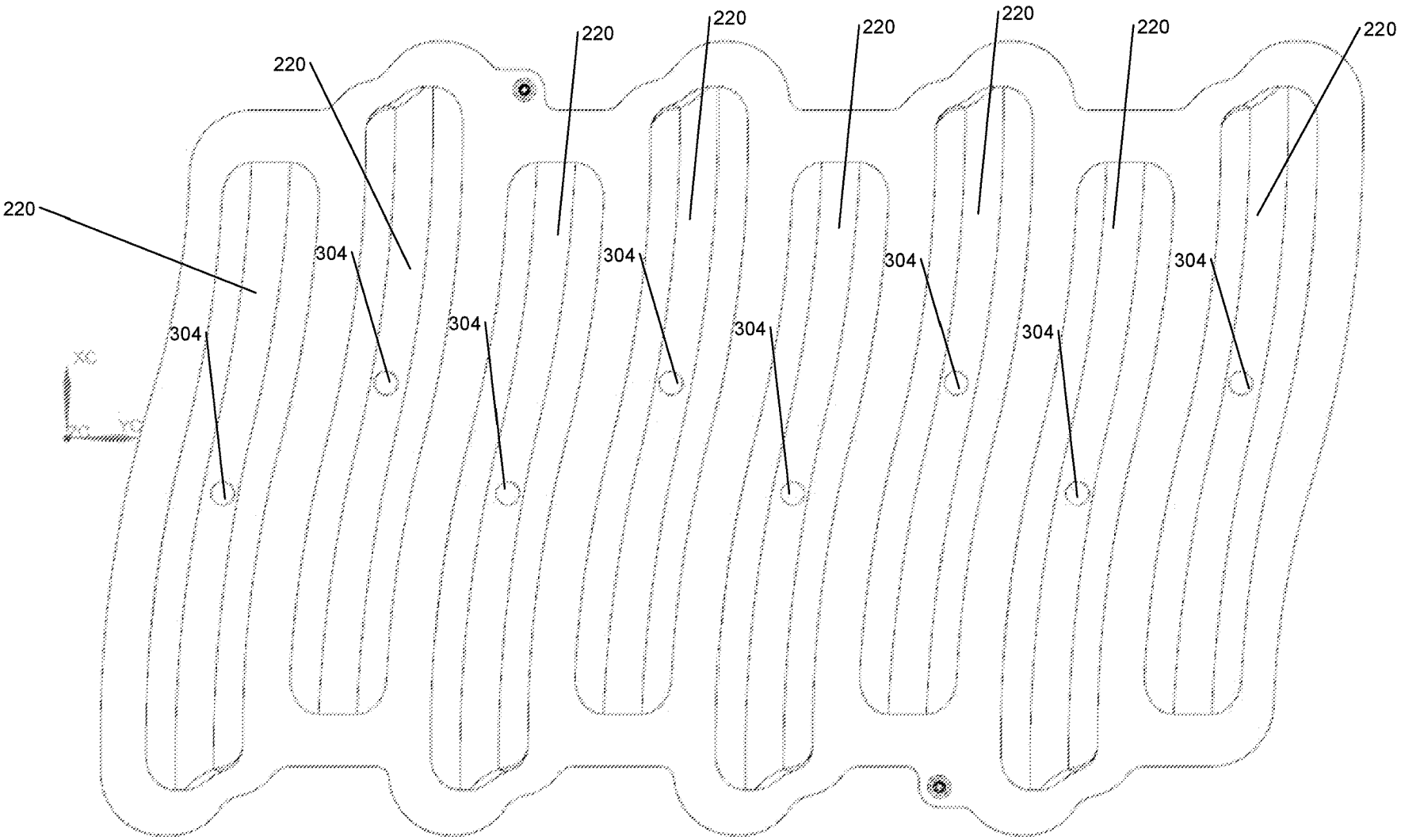

FIGS. 7-10 include an example implementation of the intake manifold 110 and the EGR plenum 173. FIG. 7 includes a perspective view from a right side of the intake manifold 110 and the EGR plenum 173. The throttle valve 112 may be fixed to a front of the intake manifold 110, such as at a flange 704. FIG. 8 includes a cross-sectional view of the intake manifold 110 and the EGR plenum 173 viewed from the front of the intake manifold and the EGR plenum 173. FIG. 9 includes a vertical cross-section through the intake manifold 110 and the EGR plenum 173. FIG. 10 includes a perspective view facing an interior portion of the intake manifold 110.

In the example of FIGS. 7-10, the apertures 304 of the EGR plenum 173 extend directly into the intake runners 220. One or more of the apertures 304 may be provided per intake runner. In various implementations, apertures may be provided for less than all of the apertures 304. For example, one aperture may be provided for every other intake runner, every third intake runner, every fourth intake runner, etc.

As shown in FIGS. 7-10, exhaust gas flows from the EGR plenum 173 into the intake manifold 110 through the apertures 304 directly into the intake runners 220. In this example, the exhaust mixes with fresh air within the intake runners 220. The location of the apertures 304 may balance the mixture of exhaust and air flowing through each of the intake runners 220.

The apertures 304 may be circular, oval shaped, rectangular shaped (with or without rounded corners), or another suitable shape. The apertures 304 may each have the same dimensions, or one or more of the apertures 304 may be different, such as to provides the same mixture of exhaust and air to each intake runner.

The flange 224 to which the EGR valve 170 can be fastened is illustrated in FIG. 7. Exhaust gas flows into the EGR plenum 173 through the aperture 232 in the flange 224. FIG. 7 includes an example illustration with the flange 224 and the aperture 232 being at a midpoint between the front and rear most portions of the EGR plenum 173. A first portion (e.g., half) of the apertures 304 may be disposed along a first line and a second portion (e.g., half) of the apertures 304 may be disposed along a second line, such as illustrated in FIGS. 8-10. The first and second lines may be parallel.

While example numbers of cylinder numbers and intake runners are provided, the present application is applicable to other numbers of cylinders and other numbers of intake runners.

Figure 11:
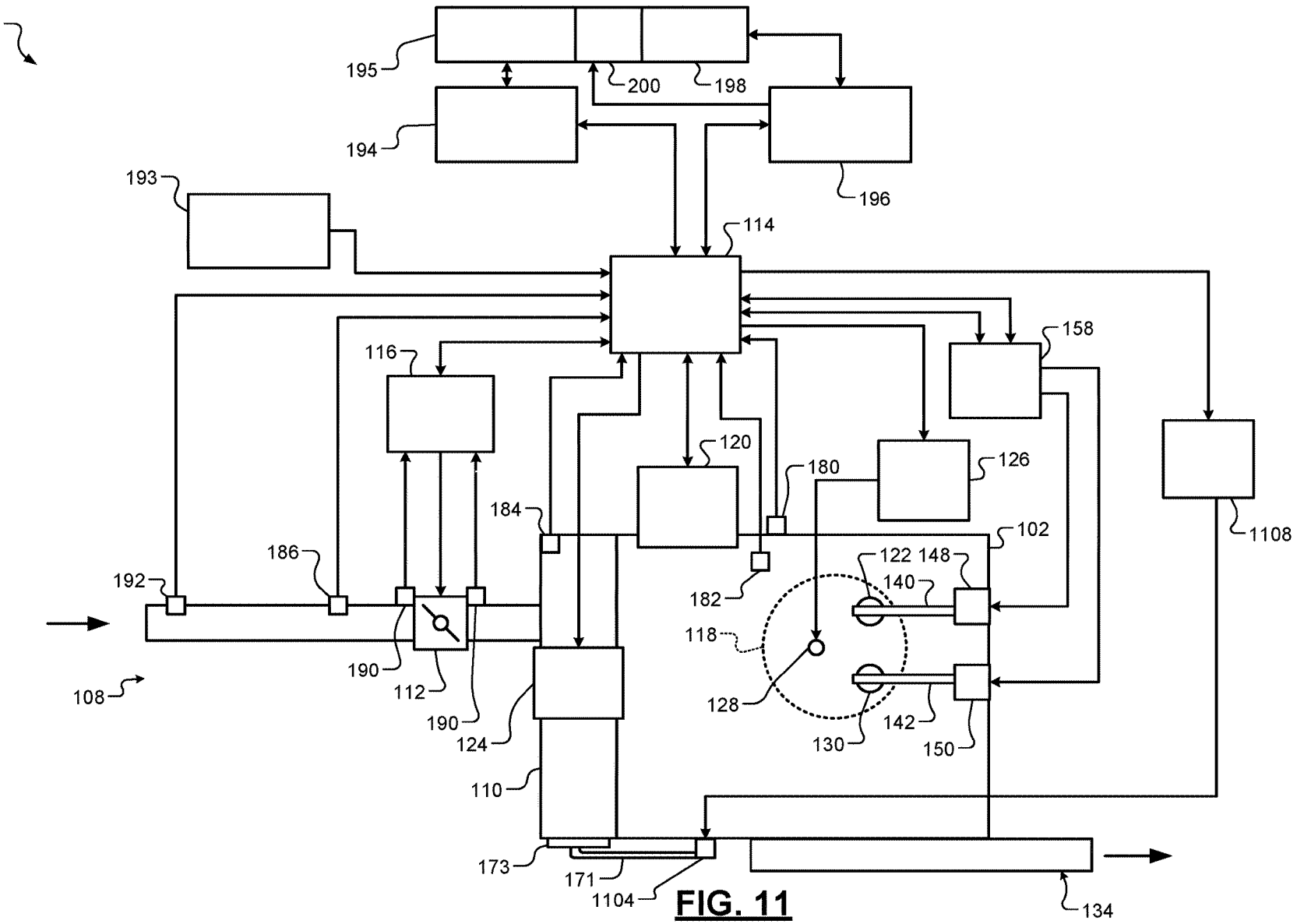
FIG. 11 is a functional block diagram of an engine system including a positive crankcase ventilation (PCV) system.

While the examples of FIGS. 2-10 illustrate the example of the EGR plenum 173, the plenum 173 may additionally or alternatively be used for (fuel) purge gas and/or positive crankcase ventilation (PCV) gas. For example, FIG. 11 is a functional block diagram of an engine system including a PCV system. A PCV valve 1104 is fluidly coupled to a crankcase of the engine 102. The PCV valve 1104 may be a passive valve and open when a pressure within the crankcase is greater than a predetermined pressure. Alternatively, the PCV valve 1104 may be an active valve and be controlled by a PCV actuator module 1108, such as based on signals from the ECM 114. Gas from within the crankcase flows to the plenum 173 through the conduit and the PCV valve 1104. While the EGR system is not illustrated in FIG. 11, EGR valve 170 and the PCV valve 1104 may both be fluidly coupled with the plenum 173 to introduce exhaust gas and/or gas from the crankcase directly into or between the intake runners 220.

Figure 12:
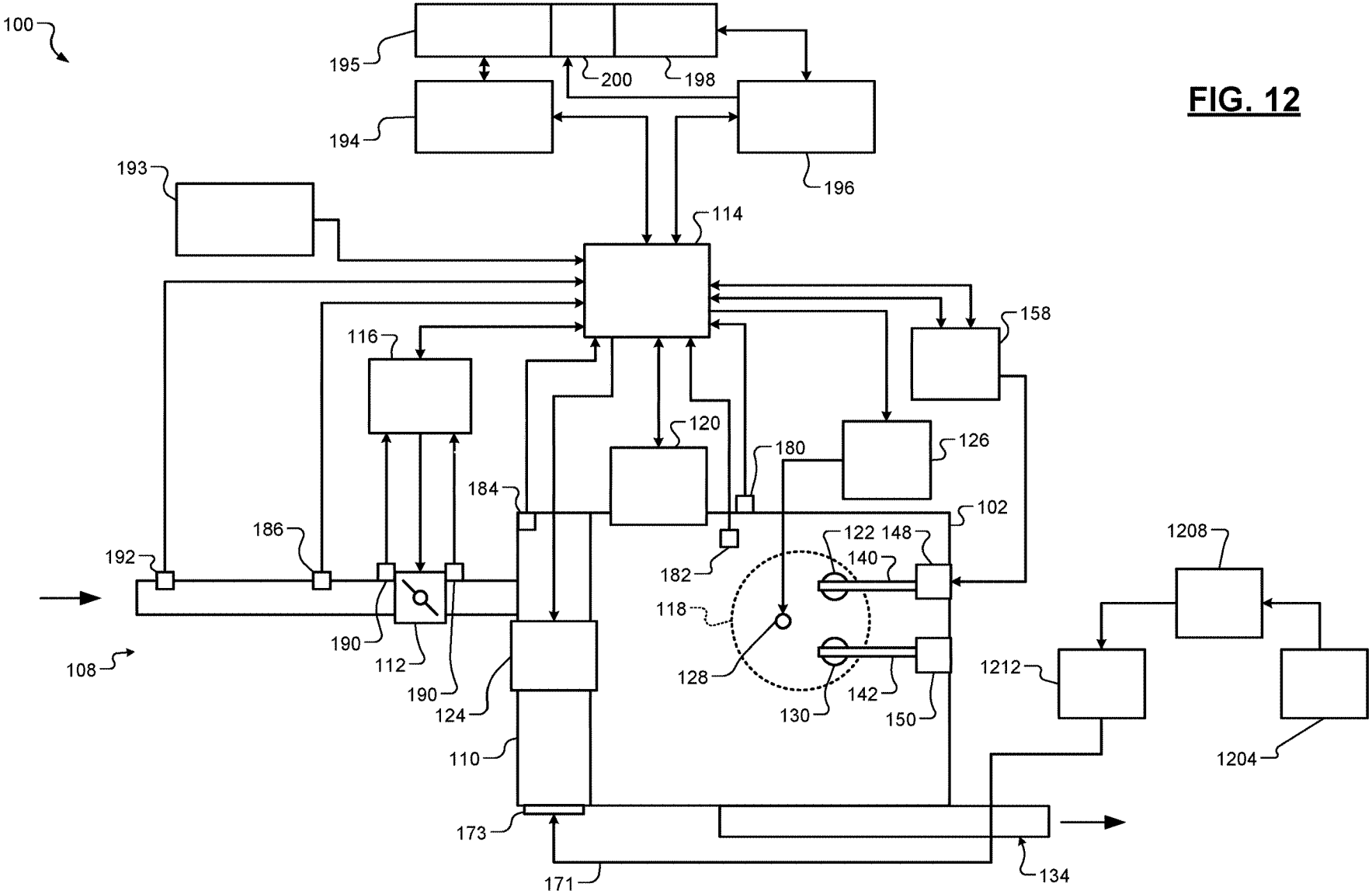
FIG. 12 is a functional block diagram of an engine system including a fuel vapor purge system.

FIG. 12 is a functional block diagram of an engine system including a fuel vapor purge system. Fuel vapor flows from a fuel tank 1204 to a fuel vapor canister 1208. The fuel vapor canister 1208 traps the fuel vapor. A purge valve 1212 is fluidly connected to the plenum 173 via the conduit 171. Vacuum may draw the fuel vapor from the fuel vapor canister 1208 through the purge valve 1212 when the purge valve 1212 is open. A purge actuator module controls opening of the purge valve 112, such as based on signals from the ECM 114. Fuel vapor flows to the plenum 173 through the conduit and the purge valve 1212. While the EGR system and the PCV system are not illustrated in FIG. 12, two or all of the EGR valve 170, the PCV valve 1104, and the purge valve 1212 may be fluidly coupled with the plenum 173 to introduce exhaust gas, gas from the crankcase, and fuel vapor directly into or between the intake runners 220. In various implementations one or more other gasses may also be introduced to improve or change engine performance.

The foregoing description is merely illustrative in nature and is in no way intended to limit the disclosure, its application, or uses. The broad teachings of the disclosure can be implemented in a variety of forms. Therefore, while this disclosure includes particular examples, the true scope of the disclosure should not be so limited since other modifications will become apparent upon a study of the drawings, the specification, and the following claims. It should be understood that one or more steps within a method may be executed in different order (or concurrently) without altering the principles of the present disclosure. Further, although each of the embodiments is described above as having certain features, any one or more of those features described with respect to any embodiment of the disclosure can be implemented in and/or combined with features of any of the other embodiments, even if that combination is not explicitly described. In other words, the described embodiments are not mutually exclusive, and permutations of one or more embodiments with one another remain within the scope of this disclosure.

Spatial and functional relationships between elements (for example, between modules, circuit elements, semiconductor layers, etc.) are described using various terms, including "connected," "engaged," "coupled," "adjacent," "next to," "on top of," "above," "below," and "disposed." Unless explicitly described as being "direct," when a relationship between first and second elements is described in the above disclosure, that relationship can be a direct relationship where no other intervening elements are present between the first and second elements, but can also be an indirect relationship where one or more intervening elements are present (either spatially or functionally) between the first and second elements. As used herein, the phrase at least one of A, B, and C should be construed to mean a logical (A OR B OR C), using a non-exclusive logical OR, and should not be construed to mean "at least one of A, at least one of B, and at least one of C."

In the figures, the direction of an arrow, as indicated by the arrowhead, generally demonstrates the flow of information (such as data or instructions) that is of interest to the illustration. For example, when element A and element B exchange a variety of information but information transmitted from element A to element B is relevant to the illustration, the arrow may point from element A to element B. This unidirectional arrow does not imply that no other information is transmitted from element B to element A. Further, for information sent from element A to element B, element B may send requests for, or receipt acknowledgements of, the information to element A.

In this application, including the definitions below, the term "module" or the term "controller" may be replaced with the term "circuit." The term "module" may refer to, be part of, or include: an Application Specific Integrated Circuit (ASIC); a digital, analog, or mixed analog/digital discrete circuit; a digital, analog, or mixed analog/digital integrated circuit; a combinational logic circuit; a field programmable gate array (FPGA); a processor circuit (shared, dedicated, or group) that executes code; a memory circuit (shared, dedicated, or group) that stores code executed by the processor circuit; other suitable hardware components that provide the described functionality; or a combination of some or all of the above, such as in a system-on-chip.

The module may include one or more interface circuits. In some examples, the interface circuits may include wired or wireless interfaces that are connected to a local area network (LAN), the Internet, a wide area network (WAN), or combinations thereof. The functionality of any given module of the present disclosure may be distributed among multiple modules that are connected via interface circuits. For example, multiple modules may allow load balancing. In a further example, a server (also known as remote, or cloud) module may accomplish some functionality on behalf of a client module.

The term code, as used above, may include software, firmware, and/or microcode, and may refer to programs, routines, functions, classes, data structures, and/or objects. The term shared processor circuit encompasses a single processor circuit that executes some or all code from multiple modules. The term group processor circuit encompasses a processor circuit that, in combination with additional processor circuits, executes some or all code from one or more modules. References to multiple processor circuits encompass multiple processor circuits on discrete dies, multiple processor circuits on a single die, multiple cores of a single processor circuit, multiple threads of a single processor circuit, or a combination of the above. The term shared memory circuit encompasses a single memory circuit that stores some or all code from multiple modules. The term group memory circuit encompasses a memory circuit that, in combination with additional memories, stores some or all code from one or more modules.

The term memory circuit is a subset of the term computer-readable medium. The term computer-readable medium, as used herein, does not encompass transitory electrical or electromagnetic signals propagating through a medium (such as on a carrier wave); the term computer-readable medium may therefore be considered tangible and non-transitory. Non-limiting examples of a non-transitory, tangible computer-readable medium are nonvolatile memory circuits (such as a flash memory circuit, an erasable programmable read-only memory circuit, or a mask read-only memory circuit), volatile memory circuits (such as a static random access memory circuit or a dynamic random access memory circuit), magnetic storage media (such as an analog or digital magnetic tape or a hard disk drive), and optical storage media (such as a CD, a DVD, or a Blu-ray Disc).

The apparatuses and methods described in this application may be partially or fully implemented by a special purpose computer created by configuring a general purpose computer to execute one or more particular functions embodied in computer programs. The functional blocks, flowchart components, and other elements described above serve as software specifications, which can be translated into the computer programs by the routine work of a skilled technician or programmer.

The computer programs include processor-executable instructions that are stored on at least one non-transitory, tangible computer-readable medium. The computer programs may also include or rely on stored data. The computer programs may encompass a basic input/output system (BIOS) that interacts with hardware of the special purpose computer, device drivers that interact with particular devices of the special purpose computer, one or more operating systems, user applications, background services, background applications, etc.

The computer programs may include: (i) descriptive text to be parsed, such as HTML (hypertext markup language), XML (extensible markup language), or JSON (JavaScript Object Notation) (ii) assembly code, (iii) object code generated from source code by a compiler, (iv) source code for execution by an interpreter, (v) source code for compilation and execution by a just-in-time compiler, etc. As examples only, source code may be written using syntax from languages including C, C++, C#, Objective-C, Swift, Haskell, Go, SQL, R, Lisp, Java®, Fortran, Perl, Pascal, Curl, OCaml, Javascript®, HTML5 (Hypertext Markup Language 5th revision), Ada, ASP (Active Server Pages), PHP (PHP: Hypertext Preprocessor), Scala, Eiffel, Smalltalk, Erlang, Ruby, Flash®, Visual Basic®, Lua, MATLAB, SIMULINK, and Python®.

What is claimed is:

1. An intake system of an internal combustion engine of a vehicle, comprising:

an intake manifold configured to be fluidly coupled to a throttle valve and intake runners for cylinders, respectively, of the internal combustion engine; and a plenum that includes a flange configured to receive gas from a valve of the vehicle, that is fixed to the intake manifold, wherein the plenum includes apertures configured to flow gas from the plenum into the intake manifold directly between adjacent ones of the intake runners, wherein the valve is one of a fuel vapor purge valve and a positive crankcase ventilation (PCV) valve.

2. The intake system of claim 1 wherein the plenum is vibration welded to the intake manifold.

3. The intake system of claim 1 wherein the intake manifold includes:

a lower portion configured to be fixed to the internal combustion engine;

a middle portion that is fixed to the lower portion; and an upper portion that is fixed to the middle portion.

4. The intake system of claim 3 wherein the lower portion is vibration welded to the middle portion, and the upper portion is vibration welded to the middle portion.

5. The intake system of claim 3 wherein the middle portion includes a second flange configured to be fluidly coupled to the throttle valve.

6. The intake system of claim 1 wherein the flange is located at a midpoint of the plenum.

7. The intake system of claim 1 wherein the flange is located closer to a front portion of the plenum than a rear portion of the plenum.

8. The intake system of claim 1 wherein the flange is located closer to a rear portion of the plenum than a front portion of the plenum.

9. The intake system of claim 1 wherein all of the apertures are the same size and shape.

10. The intake system of claim 1 wherein a first size of a first one of the apertures is different than a second size of a second one of the apertures.

11. The intake system of claim 1 wherein a first shape of a first one of the apertures is different than a second shape of a second one of the apertures.

12. The intake system of claim 1 wherein the intake manifold and the plenum are made of at least one of a plastic and a metal.

13. The intake system of claim 1 wherein the intake manifold and the plenum are made of one of Polyamide 6, Polyamide 66, glass fiber, and acrylonitrile butadiene styrene (ABS) plastic.

14. An intake system of an internal combustion engine of a vehicle, comprising:

an intake manifold configured to be fluidly coupled to a throttle valve and intake runners for cylinders, respectively, of the internal combustion engine; and a plenum that includes a flange configured to receive exhaust from an exhaust gas recirculation (EGR) valve of the vehicle, that is fixed to the intake manifold, and that includes apertures configured to flow exhaust from the plenum into the intake manifold directly between adjacent ones of the intake runners.

* * * * *